US005855959A

United States Patent [19]

Boecker et al.

[11] Patent Number: 5,855,959

[45] Date of Patent: Jan. 5, 1999

[54] PROCESS FOR PROVIDING CATALYTICALLY ACTIVE PLATINUM METAL LAYERS

[75] Inventors: Juergen Boecker, Stuttgart; Michael Butz; Alfred Frey, both of Jettingen; Petra Hofmeister, Rottenburg; Hans Dieter Schmidt, Ammerbuch, all of Germany

[73] Assignee: International Business Machines Corporation, Armonk, N.Y.

[21] Appl. No.: 42,303

[22] Filed: Apr. 2, 1993

[30] Foreign Application Priority Data

Jun. 4, 1992 [EP] European Pat. Off. ..... 92105914

[51] Int. Cl.[6] ..... B05D 3/04

[52] U.S. Cl. ..... 427/304; 427/305; 427/437; 427/438; 427/443.1

[58] Field of Search ..... 427/304, 305, 427/437, 438, 443.1

[56] References Cited

U.S. PATENT DOCUMENTS

| | | | |
|---|---|---|---|
| 3,011,920 | 12/1961 | Shipley, Jr. | 117/213 |
| 3,234,031 | 2/1966 | Zirngiebl | 106/1 |
| 3,958,048 | 5/1976 | Donovan et al. | 427/304 |
| 4,004,051 | 1/1977 | Kadison et al. | 427/304 |
| 4,520,046 | 5/1985 | McCaskie et al. | 427/304 |
| 4,704,401 | 11/1987 | Studt et al. | 514/456 |
| 4,764,401 | 8/1988 | Sirinyon et al. | 427/304 |

*Primary Examiner*—Benjamin Utech
*Attorney, Agent, or Firm*—Bernard Tiegerman

[57] ABSTRACT

A process for depositing catalytically active platinum metal layers from an ionogenic, acidic, platinum metal ions-containing solution which further contains sulfonic acid. This activation leads to more uniform catalyst layers with greater surfaces which are catalytically more efficient. The process according to the invention can be implemented in any chemical process utilizing platinum metal catalysts, e.g. chemical synthesis, environment applications or metallization of surfaces.

17 Claims, No Drawings

PROCESS FOR PROVIDING CATALYTICALLY ACTIVE PLATINUM METAL LAYERS

BACKGROUND OF THE INVENTION

1. Field of the Invention

The invention relates to catalytically active platinum metal layers.

2. Description of the Related Art

Platinum metals is the generic term for the metals of subgroup VIII of the periodic table of the elements and comprises: Ru, Rh, Pd, Os, Ir and Pt. These metals are used in various chemical processes due to their catalytic properties. Examples of processes utilizing platinum metal catalysts are hydrogenation processes, e.g. in oil and grease production and chemical synthesis, like the Fischer-Tropsch reaction, or in environmental protection, e.g. car catalysts or water cleaning. Another example of the use of platinum metal catalysts is in plating processes where they serve as a seed layer for the deposition of metal ions on dielectric or metallic surfaces.

The catalytic activity of a platinum metal seed layer depends on the nature of the surface of the platinum metal layer, i.e., the smaller the seeds and the greater their number, the better is the catalytic activity. This is true of all of the platinum metal catalyst applications cited above.

Generally, a platinum metal is conventionally deposited onto a surface from an acidic solution containing a platinum metal salt. This standard procedure is known to result in unsatisfactory platinum metal layers having undesirable irregularities and inhomogeneous thicknesses. Also, the catalytic activity of these conventionally deposited platinum metal layers has been found to be insufficient for various applications.

Several attempts to overcome the above problems are known in the prior art. One of these approaches is described in U.S. Pat. No. 4,764,401 which relates to the application of platinum metals as catalyst layers for subsequent metal deposition in plating processes. Surfaces are activated therein using organometallic complexes of elements of the groups IB and VIII of the Periodic System whose organic moiety has at least one functional group which is suitable for fixing the activator to the substrate surface. Thereby a firmly adherent metal coating is achieved, but the catalytic activity is still unsatisfactory.

Another approach has involved the addition of surfactants. A rich variety of compositions have been suggested as surfactants. For example, EP-A-0,144,612 cites several surfactants added to a colloidal solution for activating surfaces for subsequent metallization. The adhesion of copper to a substrate surface was increased thereby, but colloidal solutions are being replaced by ionogenic systems nowadays.

Yet another approach is desclosed in IBM TDB, 08–81, p. 1525. Here, sodium lignin sulfonate is added, to a colloidal system, in order to obtain palladium films of more homogeneous thicknesses and with a greater number of palladium nuclei from an acidic palladium chloride solution.

Although the above approaches have served to ameliorate the problems associated with conventionally deposited platinum metal layers, the catalytic activity thereby attained is still insufficient for many applications and these approaches also require great quantities of very expensive platinum metals. As far as plating processes are concerned, only colloidal systems are discussed, and no efficient additive for modern ionogenic activation solutions is mentioned or described.

SUMMARY OF THE INVENTION

It is an object of the present invention to provide a deposition process for producing layers of platinum metals having greater thickness uniformity and greater catalytic activity.

The above object is achieved by a process according to the present invention which comprises the following steps:

a.) providing an activator compound homogeneously distributed in a solvent, the activator compound being an ionogenic compound capable of releasing platinum metal ions, the solvent being an organic and/or inorganic acid solution;

b.) adding an anionic surfactant to the solution provided in step a.), the anionic surfactant being a sulfonic acid; and c.) applying the solution provided in step b.) to a surface to be catalyzed.

DETAILED DESCRIPTION OF THE PREFERRED EMBODIMENT(S)

This invention relates to the deposition of platinum metal layers on various surfaces, e.g. dielectric or metallic surfaces. For didactic purposes only, and without limiting the present invention to any specific application, the invention is described in the following in connection with a method for selectively chemically depositing metals such as nickel, cobalt, iron, copper or alloys thereof over existing metallurgy patterns on a dielectric substrate, and to products produced thereby. More particularly, the invention is described in connection with the electroless plating of nickel over metallurgy patterns on ceramic substrates in high-circuit-density electronic components.

In connection with the above, an important application of the present invention relates to the fabrication of multilayer ceramic modules used in semiconductor package assemblies and, more particularly, to the simultaneous chemical deposition, by electroless plating procedures, of essentially crack-free nickel of uniform thickness onto a plurality of discrete and electrically isolated contact pads on such modules, as well as onto the seal areas which surround such contact pads. Significantly, this application of the invention results in nickel layers with improved solderability, brazability, and wire and diode bonding properties as well as seal areas with improved hermetic sealing characteristics.

Generally, it is desirable that a multilayer ceramic substrate be formed with circuit lines and via holes having very small dimensions, such microminiaturization being desirable in order that the corresponding electronic package be compatible with the integrated circuit device chips which are to be mounted thereon. The module, therefore, must be provided on the top surface with many small pads which are closely spaced but electrically isolated from each other and capable of making electrical contact with correspondingly closely spaced terminal devices. In order to more efficiently use the modern integrated circuit technology, as many integrated circuit devices as possible are supported and interconnected by the same module. This arrangement keeps the distance between the interconnected devices small and thereby minimizes the time it takes for electrical signals to travel from interrelated devices. In addition, this arrangement also reduces the number of electrical interconnections which must be made and thereby reduces the cost of the package and increases its reliability. The desirable end result is a highly complex multi-layer ceramic package with a substantial amount of microsized internal printed circuitry supporting and electrically interconnecting a relatively large number of integrated circuit devices.

Multi-layer ceramic modules require complex metallurgy (i.e. the fabrication of relatively thin metallurgy layers) on the top-side to make connections to the integrated circuit devices and provide engineering change pads, and on the bottom-side to make connection to the I/O pads or other types of connections. In the next paragraphs it is shown how this metallurgy is provided on the modules.

The metallurgy pattern on the top-side surface of a (green) multi-layer ceramic module is formed, for example, by screen printing a conductive paste of a molybdenum-containing compound onto the top-side surface. The module is then sintered, and the top-side surface of the module is cleaned to remove any contaminants thereon, typically by a suitable alkaline cleaning operation. That surface is then treated to remove traces of the conductive paste from the areas between the individual circuit elements. While this step can be accomplished in a number of different ways apparent to those skilled in the art, one suitable procedure involves the application to such surface of a solution of potassium ferricyanide and potassium hydroxide, typically in a ratio of two parts of potassium ferricyanide for each part of potassium hydroxide. This step not only functions to remove traces of the conductive material which could produce short circuiting between the electrical contact pads, but also serves to activate the surface of such contact pads for subsequent plating.

Typically, the top-side surface of a ceramic module is immersed in the above-described solution for a period of from about 30 to about 50 seconds at room temperature. The surface is then rinsed to remove all traces of the alkaline solution, usually a one minute rinse with deionized water is sufficient.

Traces of glass from the conductive paste deposits are now removed by immersion of the top-side surface in a hot caustic solution such as a solution of 100 g per liter of potassium hydroxide at 100° C. for a period of from 10 to 15 minutes. If this treatment time is not sufficient, the amount of metal which is exposed may be insufficient for satisfactory plating adhesion. On the other hand, if treatment time is longer than necessary, a weakened plating bond may result. Thereafter, residual quantities of the potassium hydroxide are removed by suitable rinsing, for example with deionized water.

Surface preparation is preferably followed by dipping the top-side surface to be ultimately plated in an acid solution such as, for example, a hydrochloric acid solution having a concentration of from 1 to 10 percent by weight for a period of from 6 to 10 seconds to remove any metal oxides. Any residual hydrochloric acid remaining is removed by rinsing, again with deionized water or other suitable washing agent.

The thus prepared metallurgy pattern defined by the conductive paste is now ready to be catalyzed, that is, to make such surface receptive to accept the reduction of nickel ions by a boron containing reducing agent in the electroless bath of the chemical plating step and to accept such deposits as a uniform layer on these surfaces. In this regard, it will be appreciated that many suitable catalyzing agents will be apparent to those skilled in this art. Preferred catalyzing agents are platinum metal salts, such as chlorides, sulphates, acetates etc., (e.g. $PdCl_2$ or $PtCl_2$) which typically can be employed in an aequous solution of from about 0.01 to about 1, and preferably about 0.1, percent of platinum metal chloride. This solution is rendered acidic by the addition of organic and/or inorganic acids, like HCl, $H_2SO_4$, $CH_3COOH$ or $CCl_3COOH$ until a pH of about 0.1 to about 3.0, preferably from about 1.0 to about 2.0, is reached.

According to the present invention, a sulfonic acid is added to the above-mentioned catalyzing agent. It is important that the sulfonic acid be added in the form of an alkali-free acid and not in the salt form. Suitable sulfonic acids are arylsulfonic acids, alkylsulfonic acids or arylalkylsulfonic acids with branched or unbranched chains or mixtures thereof. The sulfonic acid is added to the platinum metal salt in a molar ratio of about 1:1 and this solution is homogenized. An actual optimum concentration of platinum metal will vary in accordance with the conditions of metallization and the particular chemical compounds selected for specific applications.

The surface to be catalyzed is then dipped into the platinum metal chloride solution containing the sulfonic acid for about 30 to about 80 seconds. This is done at temperatures from about 0° C. to about 80° C., preferably at about room temperature.

Surprisingly, the catalytic activity of the platinum metal layer deposited according to the present invention is about 40 to about 80 percent greater than without the additon of sulfonic acid and about 30 to about 40 percent greater than with sulfonate added. This is achieved with the same quantity of the catalyzing agent, with an increased number of seeds per $\mu m^2$ (70 with the addition of sulfonic acid versus 20 with standard activation) and a seed size which is below the detection limit of field emission scanning electron microscopes. Thereby the surface of the catalizing agent layer is largely increased. The seed distribution is very homogenous over the surface.

A chronopotentiometric determination of the autocatalytic dimethylamine borane (DMAB) decomposition on catalytically activated molybdenum surfaces showed that after 5 seconds in DMAB the samples prepared according to the present invention gave a significantly higher potential than standard activated samples and a constant potential was reached faster.

Furthermore, the higher surface density of the catalytic seeds leads to a "screening" of the molybdenum layer and thereby avoids corrosion thereof.

Another advantageous benefit obtained with such a platinum metal chloride solution is that it becomes absorbed on the conductive paste and is reduced thereon to the metal, a strong catalyst, while the platinum metal chloride which comes into contact with the dielectric or ceramic surface and may be present after rinsing, remains as platinum metal chloride, a relatively weak catalyst. Accordingly, during subsequent plating there is a greater tendency for the nickel to be deposited onto the contact pads and seal blank area and to thereby assure electrical isolation between the individual contact pads.

Following catalysis, the surfaces so treated are rinsed (e.g. with a solution of 5% HCl in water or 3% of citric acid in water) and the surfaces to be plated are now ready for bath immersion. As commonly accepted, the use of lead stabilizers such as, for example, lead acetate, provides advantageous deposition enhancement characteristics to the bath. Therefore, the electroless plating baths which are utilized in accordance with an important aspect of this invention, contain lead salt levels from about 0.5 to about 2 ppm. These very low level lead concentrations in combination with the relatively high levels of organic divalent sulfur stabilizer, as will be more fully described hereinafter, cooperate to provide nickel deposits of exceptionally uniform thickness on the contact pads, which deposits are also free of other surface imperfections which would render such thus deposited nickel layers otherwise generally unsuitable for meeting the exacting and high design requirements of solid state microelectronic components.

The electroless baths which are used in accordance with an important aspect of the present invention generally include a suitable nickel source, a borane reducing agent, an effective amount of an organic divalent sulfur compound which primarily functions as a bath stabilizer and, optionally, one or more additional stabilizers, buffers, buffering systems as well as wetting agents and other conventional bath ingredients.

The source of nickel cations for these nickel baths can be any of the water soluble or semi-soluble salts of nickel which are conventionally employed for such plating. Suitable metal salts which can serve as sources of the nickel cations may, for example, include nickel acetate, nickel chloride, nickel sulfamate, nickel sulfate as well as other salts of nickel and other anions which are compatible with electroless nickel systems. For example, with appropriate adjustment of the complexes, nickel glycolate as well as other nickel organic compounds can be used as the source of nickel ions in the bath. Nickel concentrations utilized in these baths are those which are typical for electroless nickel plating baths and will generally range from about 0.05 mol per liter of bath to about 1 mol per liter. The borane reducing agent utilized in these depositing baths include any bath soluble borane source such as the amine boranes, lower alkyl substituted amine boranes, and nitrogen-inclusive heterocyclic boranes including pyridine borane and morpholine borane. These compounds are typically characterized by their inclusion of a $BH_3$ group. The alkylamine boranes are preferred, with dimethylamine borane being a particularly preferred reducing agent. Generally, the reducing agent concentration used in these baths is such as to effect adequate reduction of the nickel cations within the bath under the operating conditions being employed. For example, in instances wherein a catalyzing agent is directly admixed into the conductive paste prior to application to the green sheet, high concentrations of reducing agent will be required. A typical minimum concentration for the reducing agent can be as low as about 0.002 mol per liter of bath, but more usually, however, higher concentrations ranging from 0.01 to about 0.1 mol per liter will be employed with approximately 0.04 mol per liter being preferred for most operations. In instances wherein dimethylamine borane is used, bath concentrations thereof of from 1 to 5 grams per liter are generally satisfactory with a concentration of approximately 2.0 to 2.5 grams per liter being preferred.

These nickel plating baths in accordance with an important aspect of the present invention include an organic divalent sulfur compound which is soluble in the bath and wherein each of the two valences of the sulfur atom is directly linked with a carbon atom as a bath stabilizer. Examples of suitable organic divalent sulfur compounds which are used in accordance with the present invention are the sulfur-containing aliphatic carboxylic acids, alcohols and their derivatives, the sulfur-containing aromatic/aliphatic carboxylic acids, the sulfur-containing acetylene compounds, the aromatic sulfides, the thiophenes and thionaphthenes, the thiazoles and thiourea. Illustrative examples of these organic sulfur compounds are shown and described in U.S. Pat. No. 3,234,031. Thiodiglycolic acid is a particularly preferred stabilizing agent for these nickel baths. The concentration of these sulfur-containing stabilizers will typically depend upon the particular stabilizer being employed and other bath conditions. Accordingly, effective amounts of such stabilisers can be described as those amounts which will effect the desired stability to the bath while at the same time enabling reduction of the nickel deposition onto the surfaces to be plated therein at the desired rate which will provide for, and enable the obtaining of, a nickel deposit of substantially uniform thickness, which is essentially free of irregularities in the surface without edge defects therein and which is also further characterized by being essentially crack-free. Concentrations of these sulfur-containing stabilizers will generally range from approximately 0.5 to 5 mmol per liter. In instances wherein the preferred thiodiglycolic acid stabilizer is utilized, it has been found that concentrations of such stabilizers in the bath of from approximately 25 to approximately 700 ppm can be utilized. Higher concentrations of such thiodiglycolic acid tend to substantially reduce the rate of deposition of the nickel and, accordingly, concentrations of approximately 50 to approximately 350 ppm of thiodiglycolic acid are preferred for most applications.

The nickel baths of the present invention can employ a wide variety of complexing agents, depending upon considerations such as availability, economics, and properties desired for the particular bath. Typically, bath soluble carboxylic acids, substituted carboxylic acids, and bath soluble derivatives thereof, including hydroxy-substituted carboxylic acids, and bath soluble derivatives thereof including their anhydrides, salts or esters that are likewise bath soluble can be utilized. Complexing agents which are suitable can also include ammonia and other organic complex-forming agents containing one or more of the following functional groups: primary amino groups, secondary amino groups, tertiary amino groups, imino groups, carboxy groups, and hydroxy groups. In this regard, preferred complexing agents include ethylenediamine, diethylenetriamine, triethylenetetramine, ethylenediaminetetraacetic acid, citric acid, lactic acid and water soluble salts thereof. Related polyamines and N-carboxymethyl derivatives thereof may also be used.

The complexing agent bath concentration will normally be dependent upon the particular complexing agent or agents which are being used within the bath as well as upon the operating conditions of the bath. Generally speaking, the complexing agents will be present in the nickel baths of the present invention at a concentration of at least about 0.05 mol per liter, while concentrations as high as bath solubility limits and economic considerations dictate, usually no higher than about 1.5 mol per liter can be utilized, a typical concentration being between about 0.05 and about 1 mol per liter of bath, preferably being between about 0.1 and 0.7 mol per liter.

Buffers and buffering systems are typically included within the nickel bath of the present invention. In this regard, buffering agents must be those which are not antagonistic to the plating system. Both acidic and alkaline buffering systems are generally operative including the common carboxylic acids such as acetic acid, propionic acid and the like. Typically, the bath may be buffered by adding a weak acid and its salts may be added in the desired amounts. Typically, the amount of buffering agent or the buffering system which is present in these electroless nickel baths will vary depending upon conditions. A total concentration thereof of at least approximately 0.005 mol per liter is generally suitable. The concentration of such buffering agent or system, however, will vary in accordance with the needs for maintaining pH control and usually will not exceed approximately 0.4 mol per liter. Suitable operating conditions for the nickel baths of the present invention will generally range from approximately 50° to 75° C., with a temperature of approximately 65° C. being commonly used in both barrel and rack plating operations. However, temperatures above or below these specific temperatures can be used to obtain acceptable nickel deposits on the preformed metallurgy patterns on substrate surfaces. Correspondingly, pH values for these baths will generally range from approximately 4.5 to approximately 7.5, with a pH of approximately 6.5 generally being preferred for most plating operations.

The nickel deposits which are achieved with the practice of the present invention can be characterized as high-purity nickel deposits, that is, deposits wherein the nickel concentration is at least 99.5 percent by weight with the remainder of the deposit being boron, sulfur, lead, carbon and being essentially free of other metals or contaminants. In this regard, it has been found that the boron content is primarily controlled by the concentration of the organic divalent sulfur compound stabilizer which is present in the bath and that in lead free baths using the preferred thiodiglycolic acid in the preferred concentration, nickel having boron contents of from 0.1 to 0.2 percent will be readily obtained.

The following example illustrates a preferred embodiment of the plating process which serves to describe the invention.

EXAMPLE

A multilayer ceramic module was fabricated utilizing an alumina ceramic material as previously described. The topside included contact pads and a seal band area, of a molybdenum conductive material, formed by screen printing a molybdenum and organic vehicle paste mixture on the surface of the green ceramic substrate prior to sintering. Upon sintering, the vehicle in the paste was burned off along with the binder resin in the substrate. The thickness of the molybdenum pads was 5 micrometers measured from the top surface of the substrate. The sintered substrate was initially degreased with a vapor blast and then dipped for 45 seconds in an aequeous solution of 215 grams per liter of $K_2Fe(CN)_6$ and 75 grams per liter of KOH. The surface was then rinsed for one minute with deionized water and immersed in a hot potassium hydroxide solution having a concentration of 100 grams of potassium hydroxide per liter. This step was followed by a thorough rinsing with deionized water and the surface was then dipped in a 10 percent hydrochloric acid solution for 10 seconds followed by a thorough rinsing, again with deionized water. A sulfonic acid solution of 9 wt.-% decylarylsulfonic acid 40 wt.-% undecylarylsulfonic acid 40 wt.-% dodecylarylsulfonic acid 8 wt.-% tridecylarylsulfonic acid 3 wt.-% hydrochloric acid (36%)

was prepared. The surface was then catalyzed by dipping it for 1 min in a solution containing:

| | |
|---|---|
| palladium chloride (dissolved in 10 ml of concentrated hydrochloric acid) | 0.5 g/l |
| sulfonic acid solution | 0.5 g/l |

with a pH of 1.7 (adjusted with hydrochloric acid). The surface was then rinsed by dipping it into solution of hydrochloric acid at 5% to remove palladium chloride in excess, then rinsed with deionized water to remove remaining chlorine prior to immersing it in an electroless plating bath as follows:

| | |
|---|---|
| nickel ions | 10.5 g/l |
| sodium citrate | 24 g/l |
| lactic acid | 25 g/l |
| thiodiglycolic acid | 0.17 g/l |
| wetting agent | 0.012 g/l |
| dimethylamine borane | 2.8 g/l |
| pH | 6.5 |
| bath temperature | 65° C. |

The plating was continued for approximately 45 minutes until a nickel deposit of approximately 5.0 micrometers in thickness having a boron content of 0.1 weight percent was obtained. The substrate so plated was then rinsed and observed to have a substantially uniform thickness over each of the contact pads and the seal bank area which deposits were observed to be crack-free and without any edge defects. Moreover, the individual contact pads were completely electrically isolated from each other and readily able to be joined by soldering or brazing to electrical component leads.

While the invention has been described with reference to electroplating processes, it should be evident to persons skilled in the art that the inventive steps of providing highly catalytically active platinum metal layers can be implemented in other processes using platinum metal catalytic layers.

We claim:

1. A process for depositing metallic material onto a substrate surface, comprising the steps of:

a.) providing an activator compound homogeneously distributed in a solvent, the activator compound being an ionogenic compound capable of releasing platinum metal ions, the solvent including an organic or inorganic acid;

b.) adding an anionic surfactant to the solution provided in step a.), the anionic surfactant being a sulfonic acid; and c.) applying the solution provided in step b.) to said surface, whereby catalytically active platinum metal is deposited onto said surface.

2. The process according to claim 1, wherein said anionic surfactant is selected from the group consisting of mono-, di- and polyalkylsulfonic acids, mono-, di- and polyarylsulfonic acids and mono-, di- and polyalkylarylsulfonic acids with branched and unbranched chains and mixtures thereof.

3. The process according to claim 1, wherein said anionic surfactant is n-alkylarylsulfonic acid.

4. The process according to claim 1, wherein said activator compound is provided in the form of a platinum metal salt.

5. The process according to claim 4, wherein said platinum metal salt is a platinum metal chloride.

6. The process according to claim 1, wherein said platinum metal is selected from the group consisting of palladium and platinum.

7. The process according to claim 1, wherein the concentration of the activator compound in the solvent is between about 0.01 to about 1 percent by weight and the molar ratio between activator compound and sulfonic acid is about 1:1.

8. The process according to claim 1, wherein said solvent is selected from the group consisting of HCl, $H_2SO_4$, $CH_3COOH$ and $CCl_3COOH$.

9. The process according to claim 1, wherein said solution provided in step b.) has a pH ranging from about 0.1 to about 3.0.

10. The process according to claim 1, wherein said solution provided in step b.) has a pH ranging from about 1.0 to about 2.0.

11. The process according to claim 1, wherein said solution provided in step b.) has a pH of about 1.7.

12. The process according to claim 1, wherein said solution provided in step b.) is applied at a temperature ranging from about 0° C. to about 80° C.

13. The process according to claim 1, wherein said solution provided in step b.) is applied at room temperature.

14. The process according to claim 1, wherein said surface is a metallic surface.

15. The process according to claim 14, wherein said metallic surface comprises molybdenum.

16. The process of claim 1, further comprising the step of electrolessly depositing metal onto said catalytically active platinum metal.

17. The process of claim 16, wherein said electrolessly deposited metal includes nickel.

* * * * *